US008121788B2

(12) United States Patent
Bordakov et al.

(10) Patent No.: US 8,121,788 B2
(45) Date of Patent: Feb. 21, 2012

(54) METHOD AND SYSTEM TO AUTOMATICALLY CORRECT LWD DEPTH MEASUREMENTS

(75) Inventors: Georgiy Bordakov, Richmond, TX (US); Alexander Kostin, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 191 days.

(21) Appl. No.: 11/963,225

(22) Filed: Dec. 21, 2007

(65) Prior Publication Data

US 2009/0164125 A1 Jun. 25, 2009

(51) Int. Cl.
*G01V 1/40* (2006.01)

(52) U.S. Cl. ..... 702/6; 702/9; 702/34; 702/41; 702/85; 702/104; 324/334; 324/338; 340/854.1

(58) Field of Classification Search ..... 702/6
See application file for complete search history.

(56) References Cited

U.S. PATENT DOCUMENTS

| | | | | |
|---|---|---|---|---|
| 3,497,958 | A | 3/1970 | Gollwitzer | |
| 4,556,884 | A | 12/1985 | Howells et al. | |
| 4,756,188 | A * | 7/1988 | Fennell | 73/152.49 |
| 4,852,052 | A | 7/1989 | Frey et al. | |
| 4,852,665 | A | 8/1989 | Peltier et al. | |
| 4,976,143 | A | 12/1990 | Casso | |
| 5,019,978 | A * | 5/1991 | Howard et al. | 702/6 |
| 5,062,048 | A * | 10/1991 | Coulter et al. | 702/6 |
| 6,405,136 | B1 | 6/2002 | Li et al. | |
| 6,450,259 | B1 | 9/2002 | Song et al. | |
| 6,842,699 | B2 | 1/2005 | Estes | |
| 6,868,920 | B2 * | 3/2005 | Hoteit et al. | 175/25 |
| 7,180,494 | B2 | 2/2007 | Ponzetta et al. | |
| 7,363,988 | B2 | 4/2008 | Jeffryes | |

(Continued)

FOREIGN PATENT DOCUMENTS

AU 451719 2/1971

(Continued)

OTHER PUBLICATIONS

G.A. Bordakov et al., "A New Methodology for Effectively Correcting LWD Depth Measurements," EAGE 69th Conference & Exhibition, London UK (Jun. 11-14, 2007).

(Continued)

*Primary Examiner* — Drew A Dunn
*Assistant Examiner* — Hyun Park
(74) *Attorney, Agent, or Firm* — Charlotte Rutherford; Darla P. Fonseca; Shaun B. Sethna

(57) ABSTRACT

A method for correcting errors in LWD depths includes performing torque and drag model analysis using drillstring weight, downhole friction, weight on bit, thermal expansion, rig heave and tide to produce a corrected time-depth file, wherein the torque and drag model is automatically calibrated using effective block weight, drillpipe wear, and sliding friction; and correcting time-based LWD data using the corrected time-depth file to produce depth-corrected LWD data. A system for correcting errors in LWD depths includes a processor and a memory that stores a program having instructions for: performing torque and drag model analysis using drillstring weight, downhole friction, weight on bit, thermal expansion, rig heave and tide to produce a corrected time-depth file, wherein the torque and drag model is automatically calibrated using effective block weight, drillpipe wear, and sliding friction; and correcting time-based LWD data using the corrected time-depth file to produce depth-corrected LWD data.

23 Claims, 7 Drawing Sheets

U.S. PATENT DOCUMENTS

| | | | | |
|---|---|---|---|---|
| 2003/0000300 | A1 | 1/2003 | Wong | |
| 2004/0124012 | A1 | 7/2004 | Dunlop et al. | |
| 2005/0128871 | A1 * | 6/2005 | Garcia-Osuna et al. | 367/13 |
| 2009/0038392 | A1 | 2/2009 | Aldred et al. | |

FOREIGN PATENT DOCUMENTS

| | | | |
|---|---|---|---|
| WO | 2005033473 | A1 | 4/2005 |

OTHER PUBLICATIONS

C.R. Chia et al., "A New Method for Improving LWD Logging Depth," SPE 102175, 2006 SPE Annual Technical Conference & Exhibition, San Antonio TX (Sep. 24-27, 2006).

D. Dashevskiy, "Dynamic Depth Correction to Reduce Depth Uncertainty and Improve MWD/LWD Log Quality," SPE 103094, 2006 SPE Annual Technical Conference & Exhibition, San Antonio TX (Sep. 24-27, 2006).

C.R.Chia et al., "A New Method for Improving LWD Logging Depth," SPE 102175, 2006 SPE Annual Technical Conference & Exhibition, San Antonio TX (Sep. 24-27, 2006).

D. Dashevskiy, "Dynamic Depth Correction to Reduce Depth Uncertainty and Improved MWD/LWD Log Quality," SPE 103094, 2006 SPE Annual Technical Conference & Exhibition, San Antonio TX (Sep. 24-27, 2006).

International Preliminary Report on Patentability and Written Opinion dated Jun. 22, 2010, International Application No. PCT/US2008/087143 filed Dec. 17, 2008.

* cited by examiner

METHOD AND SYSTEM TO AUTOMATICALLY CORRECT LWD DEPTH MEASUREMENTS

BACKGROUND OF INVENTION

1. Field of Invention

This invention relates to methods and systems for correcting measurement depths in well log, particularly the LWD log.

2. Background Art

Subsurface or downhole logging may be accomplished after a well is drilled using a wireline tool or while drilling using a tool attached to a drill string. In wireline logging, a well tool, comprising a number of transmitting and detecting devices for measuring various parameters, is lowered into a borehole on the end of a cable or wireline. The cable, which is attached to some mobile processing center at the surface, is the means by which log data may be sent up to the surface. With this type of logging, it becomes possible to measure borehole and formation parameters as a function of depth, i.e., based on the cable length while the tool is being pulled uphole.

Logging-while-drilling (LWD) collects data in a wellbore while the well is being drilled. By collecting and processing such information during the drilling process, the driller can modify or correct key steps in the operation, if necessary, to optimize performance. Schemes for collecting data of downhole conditions and movement of the drilling assembly during the drilling operation are known as measurement-while-drilling (MWD) techniques. Similar techniques focusing more on measurement of formation parameters than on movement of the drilling assembly are known as logging-while-drilling (LWD). Note that drilling operations may also use casings or coil tubings instead of conventional drill strings. Casing drilling and coil tubing drilling are well known in the art. In these situations, logging operations may be similarly performed as in conventional MWD or LWD. In this description, "logging-while-drilling" will be generally used to include the use of a drill string, a casing, or a coil tubing, and hence MWD and LWD are intended to include operations using casings or coil tubings. Furthermore, for clarity of illustration, in the following description, LWD will be used in a general sense to include both LWD and MWD.

In LWD logging, the measured data is typically recorded into tool memory as a function of time. At the surface, a second set of equipment records bit depth (based on drill string length or driller's depth) as function of time. When the data from the tools are made available uphole, the time-based measurements are converted to depth-based data by correlating the time information from the downhole tool with the time-depth information from the surface.

FIG. 1 shows a typical LWD system that includes a derrick 10 positioned over a borehole 11. A drilling tool assembly, which includes a drill string 12 and drill bit 15, is disposed in the borehole 11. The drill string 12 and bit 15 are turned by rotation of a Kelly 17 coupled to the upper end of the drill string 12. The Kelly 17 is rotated by engagement with a rotary table 16 or the like forming part of the rig 10. The Kelly 17 and drill string 12 are suspended by a hook 18 coupled to the Kelly 17 by a rotatable swivel 19. Drilling fluid (mud) 6 is stored in a pit 7 and is pumped through the center of the drill string 12 by a mud pump 9 to flow downwardly. After circulation through the bit 15, the drilling fluid circulates upwardly through an annular space between the borehole 11 and the outside of the drill string 12. Flow of the drilling mud 6 lubricates and cools the bit 15 and lifts drill cuttings made by the bit 15 to the surface for collection and disposal. As shown, a logging tool 14 is connected to the drill string 12. Signals measured by the logging tool 14 may be transmitted to the surface computer system 13 or stored in memory (not shown) onboard the tool 14. The logging tool 14 may include any number of conventional sources and/or sensors known in the art.

Note that while both wireline logging and LWD logging generally use similar methods to measure formation properties, their depth measurements are acquired differently. In wireline operations, the depth values come from direct measurements of the cable lengths, whereas with LWD logs, the depth-based data result from merging the time-based tool measurements and time-based driller's depth measurements. Driller's depth is based on the sum of the lengths of all pipe joints below the drillfloor plus the length of the bottom-hole assembly as measured while strapped at the surface.

FIG. 2 shows a schematic illustrating how a driller's depth is obtained on the surface. Briefly, the depth of the bit (or sensors) 23 in the well may be derived from the total pipe tally 21 minus the stick up length 22. However, the total pipe tally 21 may not correspond to the actual pipe length in the wellbore because the downhole environments (e.g., temperatures) are very different from those at the surface. Therefore, the driller's depth may not necessarily represent the actual depth of the LWD sensors downhole at all times.

Inaccurate LWD logging depths render it difficult to have reliable results from well-to-well correlations, correlations to offset well data, formation dip and formation thickness determinations. Incorrect depth measurements may also introduce artifacts and obstruct identification of geologic features. Therefore, there is a need in industry for a LWD depth measurement that is accurate, consistent between wells regardless of rig type or bottomhole assembly configuration, and independent of drilling mode.

SUMMARY OF INVENTION

One aspect of the invention relates to methods for correcting errors in logging-while-drilling (LWD) depths. A method in accordance with one embodiment of the invention includes performing torque and drag model analysis using drillstring weight, downhole friction, weight on bit, thermal expansion, rig heave and tide to produce a corrected time-depth file, wherein the torque and drag model is automatically calibrated using effective block weight, drillpipe wear, and sliding friction; and correcting time-based LWD data using the corrected time-depth file to produce depth-corrected LWD data.

Another aspect of the invention relates to systems for correcting errors in logging-while-drilling (LWD) depths. A system in accordance with one embodiment of the invention includes a processor and a memory that stores a program having instructions for: performing torque and drag model analysis using drillstring weight, downhole friction, weight on bit, thermal expansion, rig heave and tide to produce a corrected time-depth file, wherein the torque and drag model is automatically calibrated using effective block weight, drillpipe wear, and sliding friction; and correcting time-based LWD data using the corrected time-depth file to produce depth-corrected LWD data.

Another aspect of the invention relates to computer-readable media storing a program for correcting errors in logging-while-drilling (LWD) depths. A computer-readable medium in accordance with one embodiment of the invention stores a program having instructions for: performing torque and drag model analysis using drillstring weight, downhole friction, weight on bit, thermal expansion, rig heave and tide to produce a corrected time-depth file, wherein the torque and drag model is automatically calibrated using effective block weight, drillpipe wear, and sliding friction; and correcting time-based LWD data using the corrected time-depth file to produce depth-corrected LWD data.

Other aspects and advantages of the invention will be apparent from the following description and the appended claims.

DETAILED DESCRIPTION

Figure 1:
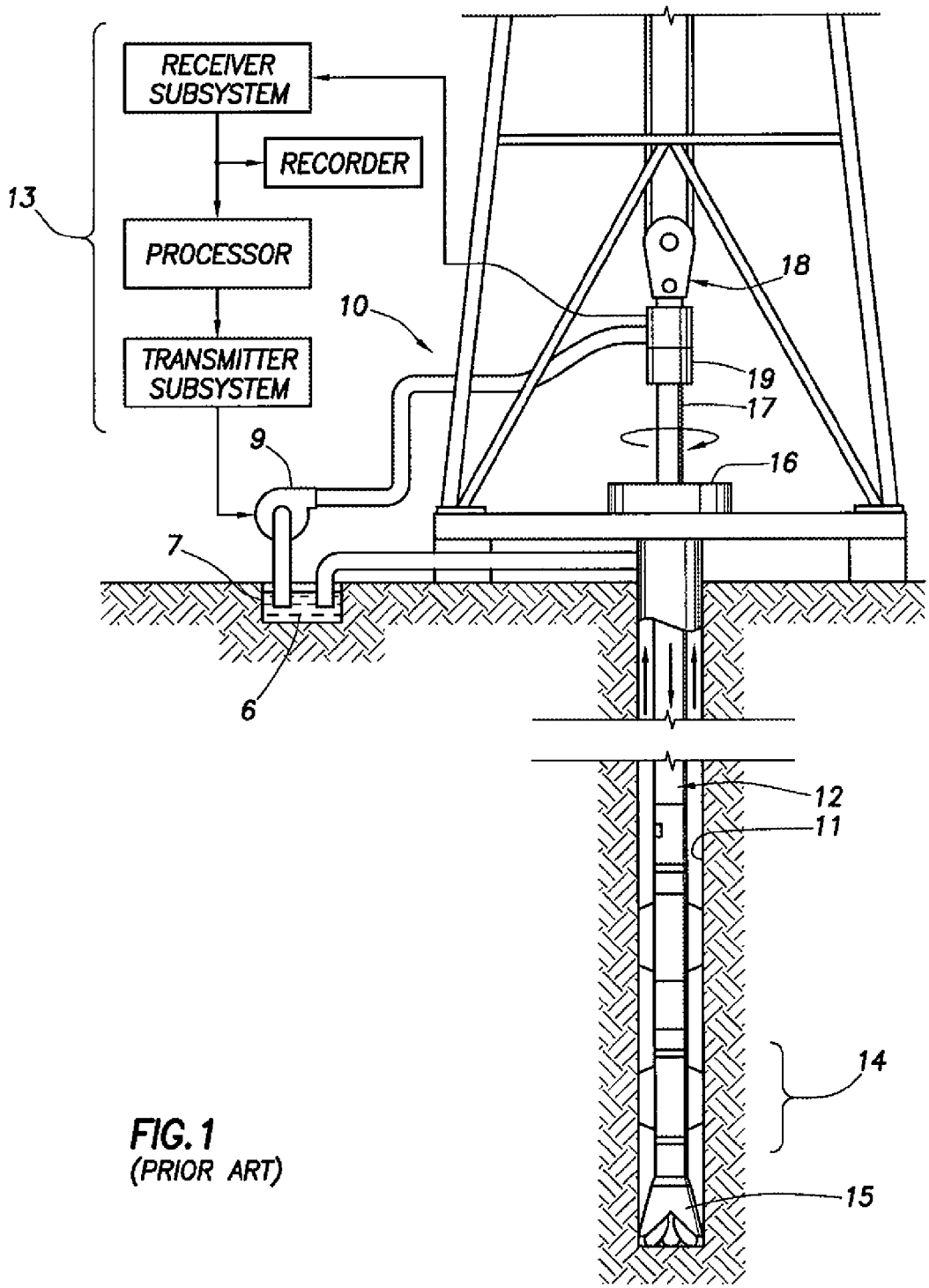
FIG. 1 (PRIOR ART)
FIG. 1 shows a conventional logging-while-drilling system.
Figure 2:
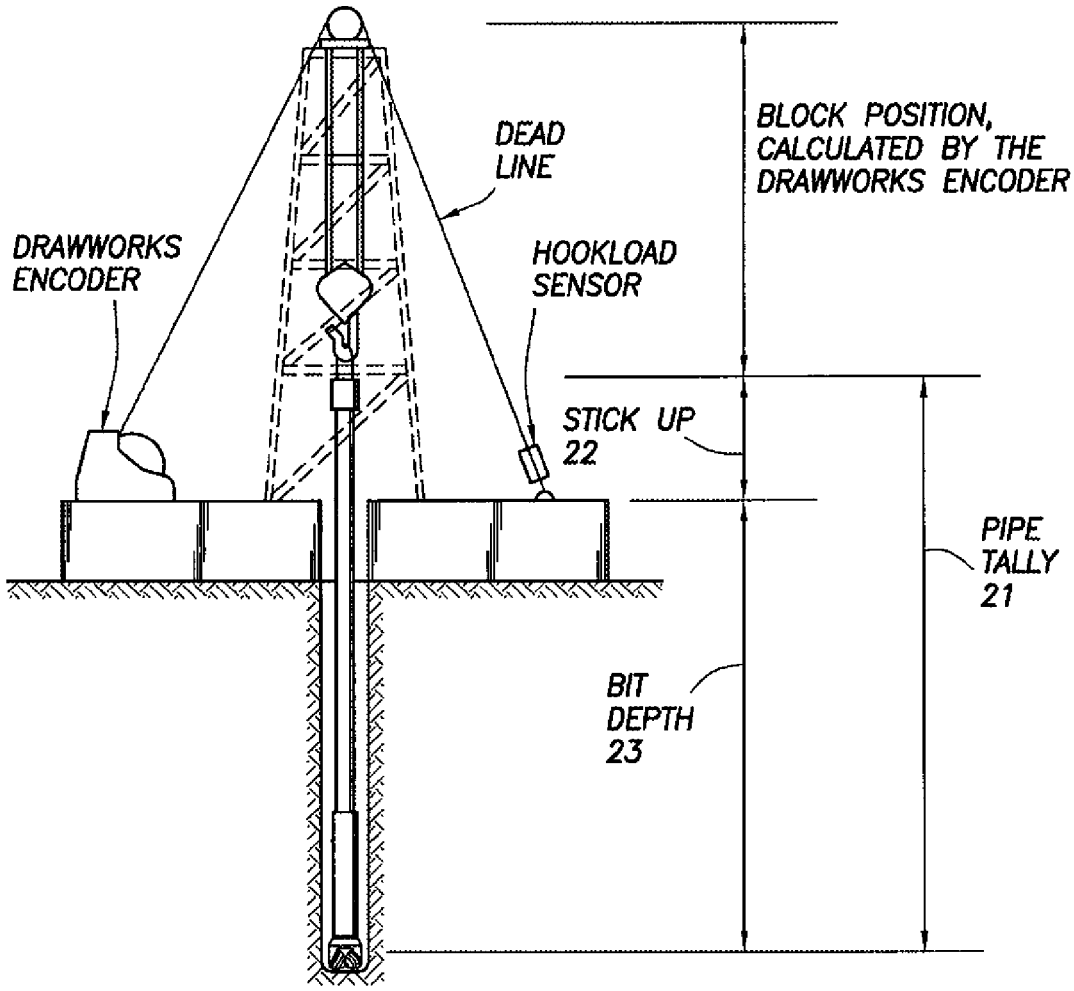
FIG. 2 shoes a schematic illustrating various surface measurements used in determining the driller's depth.

Embodiments of the invention relate to methods and systems for correcting LWD depth errors. Embodiments of the invention may be applied to any LWD measurements, including on land and off shore LWD measurements. For clarity of illustration, the following description will use offshore LWD measurements as examples. However, one of ordinary skill in the art would appreciate that the same approaches may be applied to land operations by ignoring factors that are not applicable (e.g., rig heaves and tide).

As noted above, LWD measurements are typically recorded as a function of time and then merged with the driller's depth versus time data to convert the time-based measurement data into depth-based measurement data. This approach does not always produce accurate depth conversions due to errors that might impact the accuracy of the downhole time data or the surface driller's depth time data.

Various factors affecting the differences between the driller's depths and the actual drillstring lengths downhole have been identified and discussed in Chia et al. ("*A New Method for Improving LWD Logging Depth*," SPE 102175, 2006) and Dashevskiy et al. ("*Dynamic Depth Correction to Reduce Depth Uncertainty and Improve MWD/LWD Log Quality*," SPE 103094, 2006). For example, Table 1 summarizes estimates of typical maximum magnitudes of errors associated with some factors for an S-shaped 5000 mMD (meters of measurement depth) well, with a maximum inclination of 35° and a mud weight of 2.0 g/cm$^3$, and drilled from a floater. Geothermal gradient is estimated at 25° C./1000 m. The values of the magnitudes are given the following signs: "+" for prevalent drillstring expansion, "−" for prevalent drillstring compaction, and "+/−" for no prevalent direction.

TABLE 1

Driller's and actual depth discrepancy factors comparison

| Source | Effect Max Magnitude | Time of Variation |
|---|---|---|
| Stretch due to drillstring weight | +10 m | not applicable, function of depth |
| Downhole friction | +/−1.5 m | 0.1-10 hrs |
| Weigh on bit (WOB) | +/−1 m (20-ton WOB) | 1-10 min |
| Thermal expansion | +4 m | not applicable, function of depth |
| Pressure (axial and ballooning effects) | +/−0.3 m | not applicable, function of depth |
| Buckling and twisting | +/−0.3 m | not applicable, depends on trajectory |
| Pipe tally accuracy | +/−0.3 m | not applicable |
| Rig heave | +/−1 m | 15 sec |
| Tide | +/−1 m | 6 or 12 hrs |
| Downhole clock drift | +/−0.01 to 0.2 m (2-40 sec) | not applicable, tool dependent |

Among these factors, stretch related to drillstring weight and thermal expansion are the two major causes of static errors. These are the dominant factors and are responsible for approximately 80% of the total error. Because of the typical depths and time sampling rates of LWD acquisition systems, for any effect to be significant dynamically, it should have a magnitude of at least several centimeters and a characteristic time of variation not less than several seconds. This characteristic time of variation should also be less than tens of minutes. Otherwise, the effect may be considered static. Tide is an exception to this rule and may be addressed separately. Therefore, the most significant dynamic factors are: downhole friction, WOB (weight on bit), and rig heave.

Downhole friction that affects the depth measurements is the drag against the borehole wall. This friction is highly dependent on the drilling mode—sliding or rotating—and affects the LWD depths when the drilling modes change, which is common while drilling with motors. The weight on bit (WOB) behavior is a function of the practices of a particular driller. For example, if the driller uses constant rate of penetration (ROP), the WOB will be greater for harder formations. If the driller operates the brake in steps, the WOB will express a drill-off pattern. Because static correction implies constant WOB, any variation of WOB would directly contribute to the dynamic errors.

Offshore heave compensation systems usually do not provide an accurate measurement of the compensated rig motion. Therefore, correction of error may be necessary. These errors propagate into the LWD depth tracking system in the form of a high-frequency noise, which has an adverse impact on high-resolution downhole measurements such as resistivity images. Tide effects are usually not as apparent in LWD data. However, in cases when the value of ROP times the tide half-period is close to the offset between different LWD sensors in the BHA (e.g. resistivity and density), the tide effects may become significant. As a result, log cross-correlation may be lost.

Because the LWD data are initially collected as a function of time, downhole clock drift would have an impact on the depth conversion later, as discussed by Dashevskiy et al. (2006). For example, a 40-sec drift (i.e., makes ~0.2 m at 20 m/h ROP) would produce a significant error. However, typically observed clock drifts, which are a few seconds, would not have significant impacts. Therefore, errors due to downhole clock drifts may be ignored without significant impact on the accuracy of the LWD depth data.

Similarly, other factors that do not have significant impacts can also be ignored. Pipe buckling/twisting and pressure effects are not dynamic, and they typically have small magnitudes. Chia et al. ("*A New Method for Improving LWD Logging Depth*," SPE 102175, 2006) have shown that pipe tally inaccuracy is insignificant, provided that good surface tracking policies are observed. Therefore, one may consider all factors other than downhole friction, WOB, rig heave, and tide insignificant. Accordingly, embodiments of the invention focus error correction on contributions by downhole friction, WOB, rig heave, and tide.

Chia et al. (2006) demonstrated that certain types of corrections to the driller's depth significantly improve the LWD depth accuracy and reduce the depth mismatch between LWD and wireline logs. Case studies have shown that it is possible to reduce typical depth mismatches from 10 m to 1 m for a 5000 mMD well.

The method of Chia et al. (2006) accounts for two components of depth correction: static, which represents bulk depth shift, slowly growing with depth; and dynamic, which is caused by variations of the drilling mechanics parameters with time. The impact of dynamic correction on LWD log and image quality has been described in detail by Dashevskiy et al. (2006). The correction has been shown to improve depth correlation between offset LWD sensors, leading to better formation marker identification and increased accuracy of formation thickness and dip determinations.

The existing methods of LWD depth correction are outlined in Bordakov el al., 2007 ("*A New Methodology for Effectively Correcting LWD Depth Measurements*," 69th Annual EAGE Conference & Exhibition incorporating SPE Europec 2007, 11-14 Jun. 2007, London, UK, Expanded Abstracts, D048). It is shown that it is sufficient to dynamically correct the LWD depth for drillstring weight, downhole friction, weight on bit, thermal expansion, rig heave and tide. The technique for quantifying the friction factors is based on the industry-accepted torque and drag model. Calibration of this model can be achieved using four parameters per bit-run. The method also provides uncertainty estimation for the depth correction. However, these prior art procedures require visual calibration of the model versus measurements, which requires human interactions.

Embodiments of the invention provide methods and systems for correcting LWD depth errors using procedures that do not have to rely on user intervention. Methods of the invention substitute user calibration with an automatic calibration. In accordance with embodiments of the invention, uncertainty estimation of the correction for mechanical stretch may be also automated. Therefore, embodiments of the invention can eliminate human influence and errors. Specifically, methods of the invention allow for automatic calibration of effective drillstring wear, block weight and sliding friction factor, simultaneously or separately. Furthermore, methods of the invention allow for more accurate and quantitative estimation of uncertainty of the depth correction given the values of the calibration parameters.

As noted above, methods of the invention for LWD depth correction take into account drillstring weight, downhole friction, weight on bit, thermal expansion, rig heave and tide. In addition, methods of the invention may be performed on a per bit-run basis and may use four calibration parameters: mud weight, effective drillstring wear, block weight and sliding friction factor. Sliding friction factor is assumed to be constant along the borehole and rotating friction factor is assumed to be zero.

Figure 3:
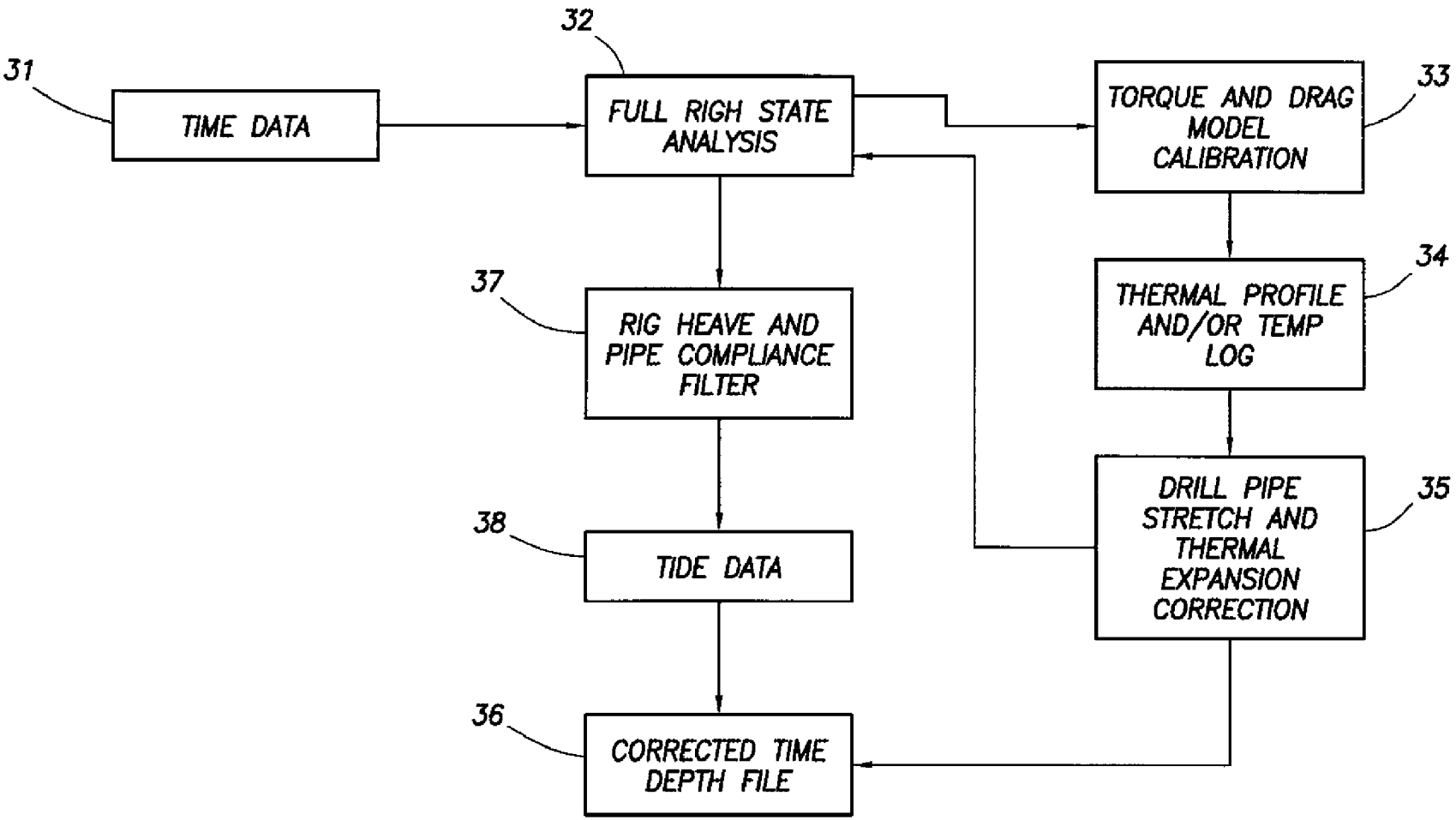
FIG. 3 shows a flowchart illustrating a method for correcting depth errors in LWD data in accordance with one embodiment of the invention.

FIG. 3 shows a workflow in accordance with embodiments of the invention. This workflow may be implemented in software which can be run post job or in real time. In this software, a user may perform full rig state analysis 32 based on time data 31. Then, a user may calibrate and run torque and drag module 33, and add thermal expansion correction 34, 35. After calculating drill pipe stretch and thermal expansion correction, a user may recompute or redo rig state analysis 32 based on the corrected data. Furthermore, the user my also filter out rig heave 37 and add tide 38 data post job, if necessary. Finally, a user can produce corrected time and depth file 36, which may be forwarded to an acquisition system or other analysis system.

To run calibrate and run torque and drag model analysis, one may use any commercially available torque and drag analysis software, such as DrillSAFE®, which is part of Schlumberger DrillingOffice®, or DeaDrag8® from Drilling Engineering Association.

Figure 4:
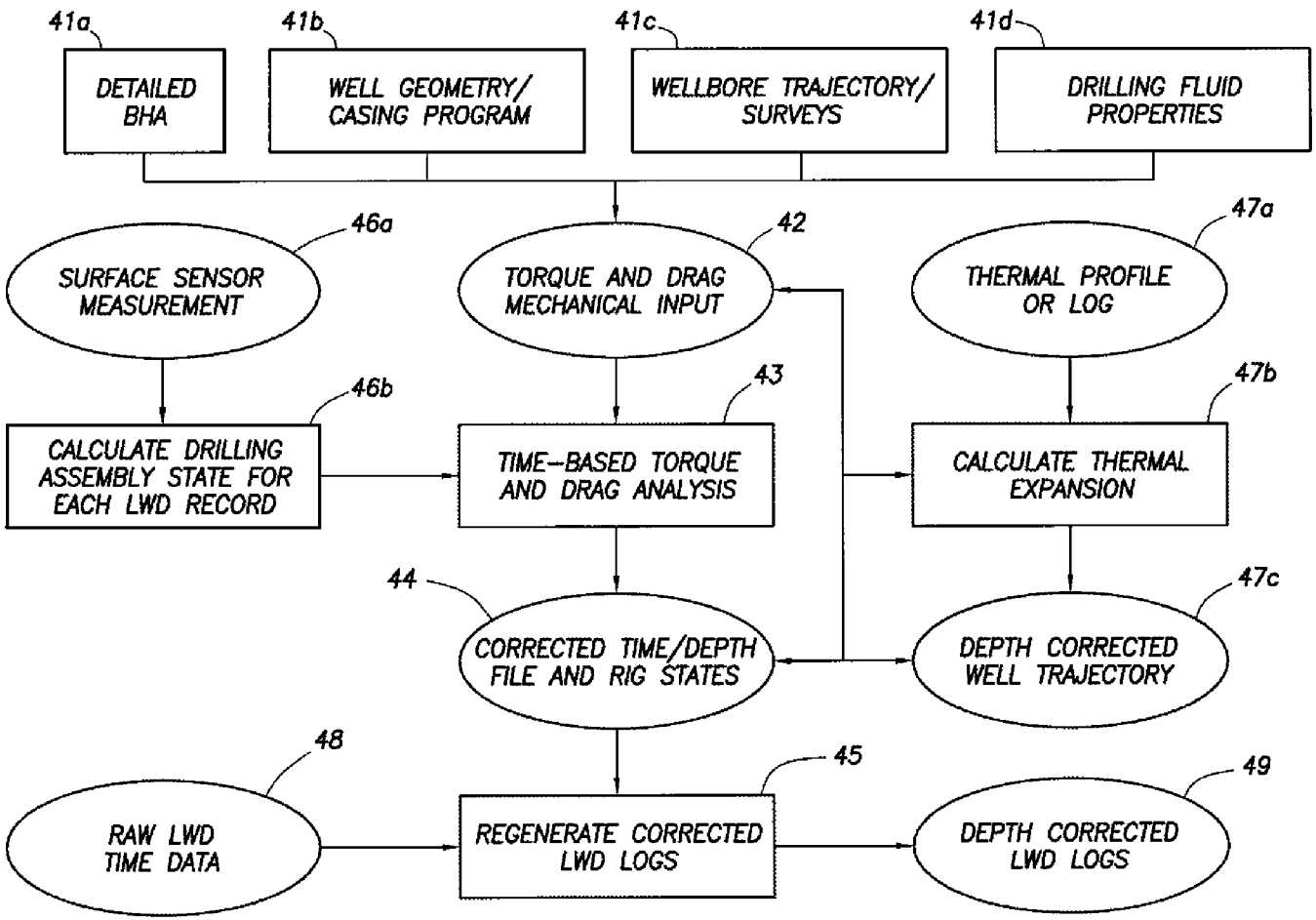
FIG. 4 shows a flowchart illustrating workflow of a torque and drag modeling in accordance with one embodiment of the invention.

FIG. 4 shows a typical workflow of a torque and drag analysis software. As shown, the torque and drag mechanical input 42 may be provided by detailed BHA information 41*a*, well geometry or casing program 41*b*, detailed wellbore trajectory or surveys 41*c*, and drilling fluid properties 41*d*. The other input for the analysis program is the drilling assembly state for each LWD record 46*b*, which may be provided from the surface sensor measurements 46*a*. The torque and drag mechanical input 42 and the drilling assembly state information 46*b* are input to the time-based torque and drag analysis program 43 to produce a corrected time-depth file and rig states 44. The corrected time-depth file and with rig states 44 are then used together with raw LWD time data 48 in a process to regenerate corrected LWD logs 45, which results in depth-corrected LWD logs 49.

In accordance with some embodiments of the invention, the thermal profile or log 47*a* may be used to calculate thermal expansion correction 47*b*, which generates depth corrected well trajectory 47*c*. The depth corrected well trajectory 47*a* after thermal correction may be used to improve the corrected time-depth file and rig states 44 so that more accurate depth-corrected LWD logs 49 may be generated.

In accordance with methods of the invention, calibration of mud weight may be omitted and the mud weight value in the driller's report is used, because changing mud weight results in the same effect as changing effective drillpipe wear. The other parameters (i.e., effective block weight, effective drillstring wear, and effective sliding friction factor) are calibrated. For the calibration, the following measured and theoretical data are used:

- Trip-In Actual Hookloads (TIAH)—hookload sensor measurements versus drillers' depth in the cases when the rig is in off-bottom sliding going down not in slips state.
- Trip-Out Actual Hookloads (TOAH)—hookload sensor measurements versus drillers' depth in the cases when the rig is in off-bottom sliding going up not in slips state.
- Rotating Actual Hookloads (RAH)—hookload sensor measurements versus drillers' depth in the cases when the rig is in off-bottom rotating not in slips state.
- In-Slips Actual Hookloads (ISAH)—hookload sensor measurements in the cases when the rig is in slips state.
- Trip-In Model Hookloads (TIMH)—theoretical hookload versus depth calculated with torque and drug modeling code with zero weight on bit and constant friction factor equal to the given effective sliding friction factor assuming the drillstring is going down.
- Trip-Out Model Hookloads (TOMH)—theoretical hookload versus depth calculated with torque and drug modeling code with zero weight on bit and constant friction factor equal to the given effective sliding friction factor assuming the drillstring is going up.

Rotating Model Hookloads (RMH)—theoretical hookload versus depth calculated with torque and drug modeling code with zero weight on bit and constant friction factor equal to zero.

In accordance with embodiments of the invention, all measured and theoretical data are preferably considered primarily for the depth intervals where drilling is performed in the particular run, because other depths are irrelevant for the LWD data acquisition. If there are not enough data in these drilling intervals (e.g. for short runs such as 100 ft length), the entire set of data may be considered. However, in this case, data for drilling intervals may be assigned more weight in the analysis.

Figure 5:
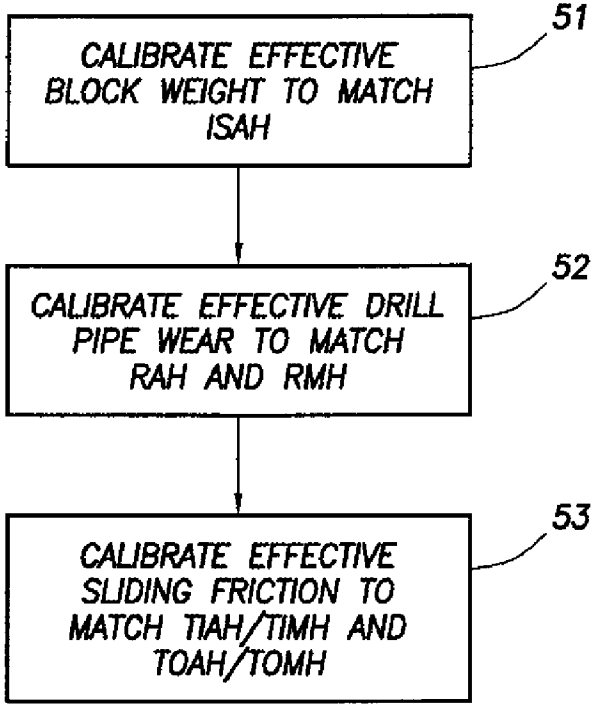
FIG. 5 shows a flowchart illustrating a method for calibrating a torque and drag model in accordance with one embodiment of the invention.

As shown in FIG. 5, in accordance with one embodiment of the invention, calibrations of parameters may be performed as follows. First, an effective block weight may be calibrated to match ISAH data (step 51). For example, the median of ISAH may be used as effective block weight. Next, an effective drillpipe wear may be calibrated to match RAH and RMH data (step 52). Any automatic minimization procedure can be used in such calibration. Calibration of the effective drillpipe wear may be performed after an effective block weight is chosen or calibrated as described in step 51 or set by a user. In an alternative embodiment, both the effective block weight and the effective drillpipe wear may be simultaneously minimized to match ISAH and RAH/RMH, respectively.

Given the effective block weight and drillpipe wear, an effective sliding friction factor may be calibrated (step 53). The effective sliding friction factor may be calibrated to match TIAH/TIMH and TOAH/TOMH data pairs. Again, any automatic minimization procedure can be used. Calibration of the effective sliding friction factor may be performed after the effective drillpipe wear and the block weight are chosen as described in steps 51 and 52, or set by a user. Alternatively, the effective sliding friction factor may be simultaneously minimized with the two calibration/minimization processes in steps 51 and 52 so that the results match TIAH/TIMH, TOAH/TOMH, RAH/RMH and ISAH/block weight data.

Given a mud weight and an effective block weight, the uncertainty of the mechanical stretch due to drillpipe wear and sliding friction factor (as obtained from calibration described above or visually set by user) may be estimated by introducing scattering into one of the model calibration parameters to match the scattering of TIAH and TOAH points. While any of the above-mentioned parameters (e.g., mud weight drillpipe wear, and sliding friction factor) may be used to estimate the uncertainty, the following will use the sliding friction factor as an example. Estimated parameter (e.g., sliding friction factor) uncertainty may then be propagated into torque and drug modeling to produce a depth uncertainty.

Figure 6:
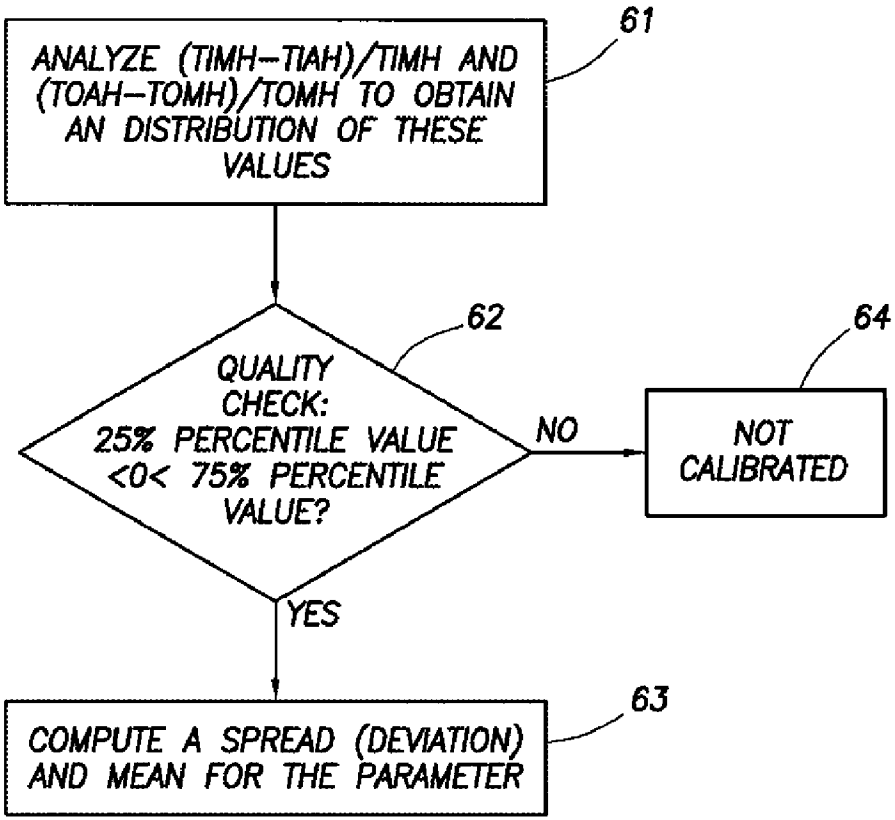
FIG. 6 shows a flowchart illustrating a process for estimating an uncertainty in the depth correction in accordance with one embodiment of the invention.

FIG. 6 shows one example for estimating a friction factor uncertainty, in accordance with embodiments of the invention. In accordance with the method shown in FIG. 6, distribution of parameter values such as (TIMH-TIAH)/TIMH and (TOAH-TOMH)/TOMH may be analyzed to get a profile of their distribution (step 61). From the distribution profile, one may choose two reference points (e.g., at 25% percentile and 75% percentile) for analysis of the value distribution. If the calibration of the parameter (e.g., the sliding friction factor) has been performed properly, the values at these two points (25% percentile and 75% percentile) should be non zero, and the 25% percentile value should be negative, while the 75% percentile value should be positive. Thus, the method performs a quality check to seen whether the values at these two points are negative and positive, respectively (step 62). This quality check should be true both for individual and combined distributions such as (TIMH-TIAH)/TIMH and (TOAH-TOMH)/TOMH. If it is not the case, parameters are declared not calibrated (shown as 64) and depth correction would not be reliable.

If the values pass the quality check in step 62, the method next calculates the spread and mean of the parameter (step 63). The spread of a particular parameter may be obtained by increasing or lowering the initial calibrated value of the parameter to a point that results in a match between the distribution of a derived parameter (i.e., a secondary parameter derived from the parameter being analyzed) and the distribution actually observed for this secondary parameter. The mean can then be defined from the spread of the parameter.

For example, the parameter (e.g., sliding friction factor) is increased with respect to the given calibrated value, and the TIMH and TOMH curves are calculated based on that increased parameters, to produce TIMHi and TOMHi, respectively. Then, the values (spread values) of (TIMH-TIMHi)/TIMH and (TOMHi-TOMH)/TOMH are calculated. The sliding friction factor is increased until medians of these spread values match the above-mentioned 75% percentile values of (TIMH-TIAH)/TIMH and (TOAH-TOMH)/TOMH, respectively.

Because hookloads are monotonous functions of friction factor, the newly obtained friction factor value may be considered as the 75% percentile value of the sliding friction factor distribution. By decreasing the sliding friction factor to match the 25% percentile value of (TIMH-TIAH)/TIMH and (TOAH-TOMH)/TOMH in a manner similar to that described above, one can estimate the 25% percentile value of the sliding friction factor. Then, the calibrated value of this parameter may be defined as the median (i.e., 50% percentile value) of the 25% and 75% percentile values. By assuming a simple distribution (e.g., a normal distribution) for the sliding friction factors, the standard deviation can be found from a pair of the percentiles. If estimates from different pairs give different values, the greater value is taken as the standard deviation estimate. This standard deviation value may then be propagated into the torque and drug model to estimate the standard deviation of depth, and hence the depth correction uncertainty.

Although the above estimation of uncertainty is described using the sliding friction factor, other parameters (such as mud weight and drillpipe wear, or any calibration parameter, from which the hookloads depend monotonously) can be used for uncertainty estimation in a similar manner. In addition, not only the 25% and 75% percentile values, but also other representative percentiles below and above the median, such as 20%, and 80% percentiles or 35% and 65% percentiles, may be used.

Estimation of uncertainty in this way may be performed automatically. It provides quality measure of the performed calibration, which can be performed both automatically as described above or visually with human interaction as performed in the prior art method.

Methods of the invention have been shown to provide accurate correction of LWD depth logs. The following examples illustrate the application of methods of the invention.

Figure 7:
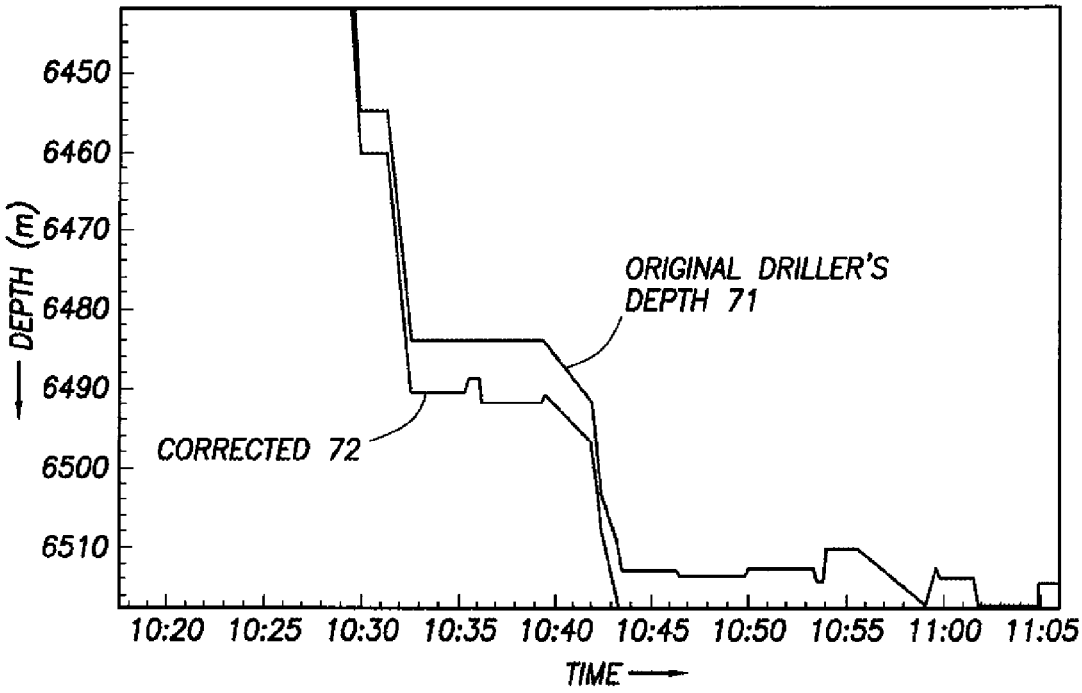
FIG. 7 shows a chart, illustrating a corrected depth-time curve as compared with the original driller's depth curve.

FIG. 7 shows a chart illustrating correction of a time-depth curve. The original driller's depth curve 71 and the corrected curve 72 differ by as much as 8 meters in this example. Assuming conventional logic of using the time when the depth is first reached, based on the original driller's depth (curve 71), the depth log at the interval from 6482 to 6488 m should correspond to the time records from 10:40 to 10:43. However, based on the corrected time-depth curve 72, the same depth log should correspond to the time records around 10:32. The time records for these two areas could be different because they are 11 min apart.

Figure 8A:
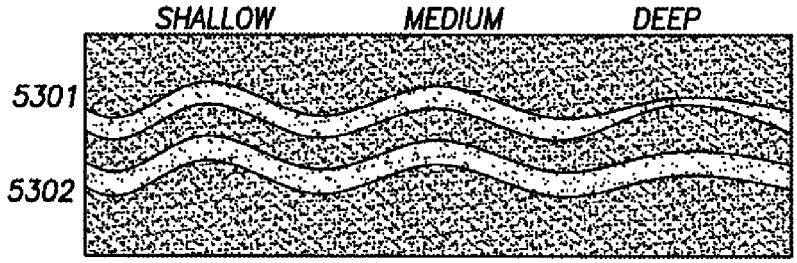
FIGS. 8A and 8B show an example of resistivity images before and after, respectively, depth correction in accordance with one embodiment of the invention.

FIG. 8A shows a resistivity-at-bit (RAB) log using three electrodes having different depth of investigation (DOI; the distance from the borehole into the formation). It is apparent that the image obtained from the deep measurements (shown with an arrow) has a shape that is different from those obtained with the shallow and medium measurements. This image actually contains artifact caused by the drill-off. Based on drilling mechanics logs, at 22:30, the driller locked the brake, and the block velocity became 0. The hole depth measured at surface remained constant for 4 minutes while the brake was locked. During this time the hookload increased by approximately 2 tons from 122.6 tons, and surface weight on bit fell accordingly. This is a clear indication of a drill-off. The bit drilled through a rock, but the drillpipe on the surface did not move. During this time, the deep resistivity sensor actually moved approximately 20 centimeters and logged the formation feature, but it was lost in processing.

Figure 8B:
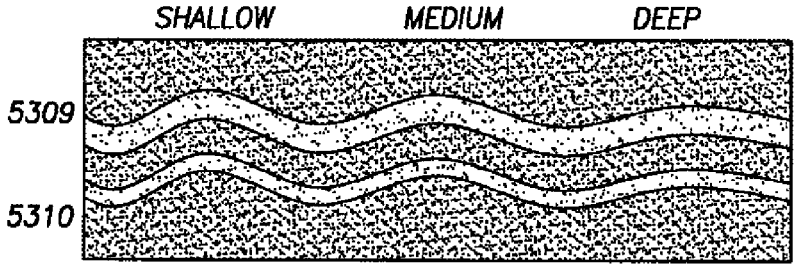

After correction, the shallow, medium and deep resistivities look similar (FIG. 8B). The shallow and medium resistivities do not change much because they were not affected by the drill-off. This is because these two sensors are at different distances from the bit, as compared with the deep sensor (closest to the bit), and therefore they have passed this formation feature at different times.

Figure 9B:
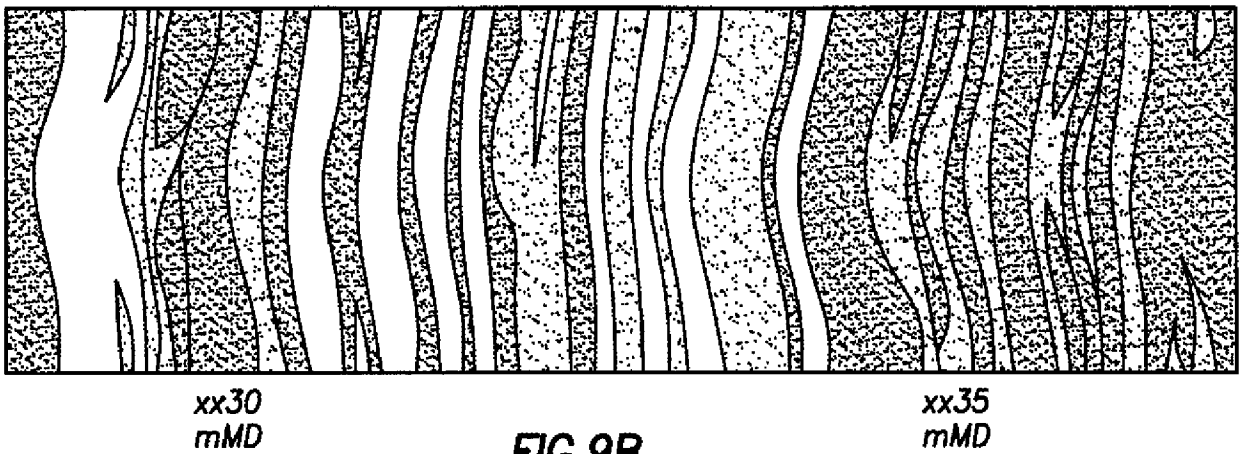
FIGS. 9A and 9B show an example of resistivity images before and after, respectively, rig heave correction in accordance with one embodiment of the invention.
Figure 9A:
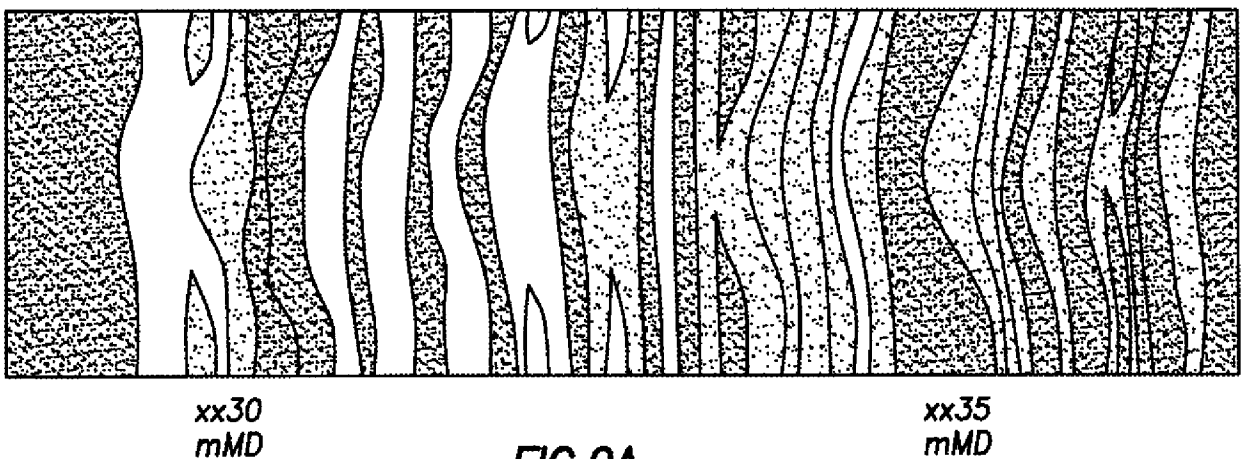

While in some situations, just using the above depth correction will produce satisfactory results) in other situations further correction of errors due to other factors (e.g., rig heave or tide) might be needed. FIG. 9A shows an original resistivity log after depth correction as described above. This log shows substantial "depth noise." This noise is caused by oscillations of the surface bit depth measurement versus time, which are caused in turn by rig heave. Rig heaves produce sinusoidal oscillations that can be easily identified. Similarly, tide effects are readily identified, if the tide information is available. FIG. 9B shows the same log after heave correction, which compensates for the "depth noise." Apparently, it has much less noise.

Some embodiments of the invention relate to systems that are configured to perform a method of the invention. A system in accordance with embodiments of the invention would include a processor and a memory that stores a program having instructions to cause the processor to perform the steps of a method of the invention. Such methods may be implemented with any computer (such as a personal computer) known in the art or a computing or processor unit used in a laboratory or on a tool for oil and gas exploration. Some embodiments of the invention relate to computer-readable media that store a program having instructions for performing steps of a method of the invention. Such computer-readable media, for example, may include hard drive, diskette, compact disk, optical disk, tape, and the like.

Advantages of embodiments of the invention may include one or more of the following. Methods of the invention may provide automated depth correction for LWD logs. These methods can be performed without user intervention, thus reducing human errors or bias. Methods of the invention can produce LWD depth logs that are more accurate than the results traditionally obtained with driller's depth.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for correcting errors in logging-while-drilling (LWD) depths, comprising:

executing, via a processor, program instructions capable of:

performing torque and drag model analysis using drillstring weight, downhole friction, weight on bit, thermal expansion, rig heave and tide to produce a corrected time-depth file, wherein the torque and drag model is automatically calibrated using effective block weight, drillpipe wear, and sliding friction; and correcting time-based LWD data using the corrected time-depth file to produce depth-corrected LWD data, wherein the torque and drag model is calibrated by performing:

calibrating the effective block weight to match in-slip actual hookload (ISAH);

calibrating the mud weight to match rotating actual hookload (RAH) and rotating model hookload (RAM); and calibrating the effective sliding friction to match TIAH/TIMH and TOAH/TOMH, wherein TIAH is trip-in actual hookload, TIMH is trip-in model hookload, TOAH is trip-out actual hookload, and TOMH is trip-out model hookload; and estimating an uncertainty of a mechanical stretch due to at least one of drillpipe wear and sliding friction by steps comprising determining a scattering of the TIAH and TOAH: and introducing scattering into at least one of the drillpipe wear and the sliding friction to match the scattering of the TIAH and TOAH.

2. The method of claim 1, wherein the torque and drag model is automatically calibrated using mud weight as an additional factor.

3. The method of claim 1, further comprising correcting rig heave errors, tide errors, or both rig heave and tide errors in the depth-corrected LWD data.

4. The method of claim 1, further comprising correcting thermal expansion errors in drillpipe.

5. The method of claim 1, further comprising estimating uncertainty of depth correction due to mechanical stretch.

6. The method of claim 5, wherein the estimating of the uncertainty is performed by analyzing a distribution of values of a parameter selected from the group consisting of mud weight, drillpipe wear, sliding friction factor, and a combination thereof, provided TIAH and TOMH are monotonous functions of the combination, wherein TIAH is trip-in actual hookload and TOMH is trip-out model hookload.

7. The method of claim 1, wherein calibrating the effective drillpipe wear and/or mud weight to match rotating actual hookload (RAH) and rotating model hookload (RAM) comprises calibrating the effective drillpipe wear and/or mud weight to match rotating actual hookload (RAH) and rotating model hookload (RAM).

8. A system for correcting errors in logging-while-drilling (LWD) depths comprising a processor and a memory that stores a program having instructions for:

performing torque and drag model analysis using at least one of drillstring weight, downhole friction, weight on bit, thermal expansion, rig heave and tide to produce a corrected time-depth file, wherein the torque and drag model is automatically calibrated using drillpipe wear; and correcting time-based LWD data using the corrected time-depth file to produce depth-corrected LWD data, wherein the torque and drag model is calibrated by performing:

calibrating the effective block weight to match in-slip actual hookload (ISAH);

calibrating the effective drillpipe wear to match rotating actual hookload (RAH) and rotating model hookload (RAM) by steps comprising collecting ISAH data, determining a median of the ISAH data collected, and setting the effective block weight to the median of the ISAH data collected; and calibrating the effective sliding friction to match TIAH/TIMH and TOAH/TOMH, wherein TIAH is trip-in actual hookload, TIMH is trip-in model hookload, TOAH is trip-out actual hookload, and TOMH is trip-out model hookload; and estimating an uncertainty of a mechanical stretch due to at least one of drillpipe wear and sliding friction by steps comprising determining a scattering of the TIAH and TOAH: and introducing scattering into at least one of the drillpipe wear and the sliding friction to match the scattering of the TIAH and TOAH.

9. The system of claim 8, wherein the torque and drag model is automatically calibrated using at least one of effective block weight, sliding friction, and mud weight as an additional factor.

10. The system of claim 8, wherein the program further comprises instructions for correcting rig heave errors, tide errors, or both rig heave and tide errors in the depth-corrected LWD data.

11. The system of claim 8, wherein the torque and drag model is calibrated by further performing calibrating the mud weight to match rotating actual hookload (RAH) and rotating model hookload (RAM).

12. The system of claim 8, wherein the program further comprises instructions for estimating uncertainty of depth correction due to mechanical stretch.

13. The system of claim 12, wherein the estimating of the uncertainty is performed by analyzing a distribution of values of a parameter selected from the group consisting of mud weight, drillpipe wear, sliding friction factor, and a combination thereof, provided TIAH and TOMH are monotonous functions of the combination, wherein TIAH is trip-in actual hookload and TOMH is trip-out model hookload.

14. The system of claim 8, wherein the program further comprises calibrating the effective mud weight to match rotating actual hookload (RAH) and rotating model hookload (RAM) comprises calibrating the effective drillpipe wear and/or mud weight to match rotating actual hookload (RAH) and rotating model hookload (RAM).

15. A non-transitory computer-readable medium containing computer instructions stored therein for causing a computer processor to perform:

performing torque and drag model analysis using tide to produce a corrected time-depth file, wherein the torque and drag model is automatically calibrated using at least one of effective block weight, drillpipe wear, and sliding friction; and correcting time-based LWD data using the corrected time-depth file to produce depth-corrected LWD data, wherein the torque and drag model is calibrated by performing:

calibrating the effective block weight to match in-slip actual hookload (ISAH);

calibrating the effective drillpipe wear and mud weight to match rotating actual hookload (RAH) and rotating model hookload (RAM); and calibrating the effective sliding friction to match TIAH/TIMH and TOAH/TOMH, wherein TIAH is trip-in actual hookload, TIMH is trip-in model hookload, TOAH is trip-out actual hookload, and TOMH is trip-out model hookload; and estimating an uncertainty of a mechanical stretch due to at least one of drillpipe wear and sliding friction by steps comprising determining a scattering of the TIAH and TOAH; and introducing scattering into at least one of the drillpipe wear and the sliding friction to match the scattering of the TIAH and TOAH.

16. The non-transitory computer-readable medium of claim 15, wherein the torque and drag model is automatically calibrated using mud weight as an additional factor.

17. The non-transitory computer-readable medium of claim 15, wherein the program further comprising instructions for correcting rig heave errors, tide errors, or both rig heave and tide errors in the depth-corrected LWD data.

18. The non-transitory computer-readable medium of claim 15, wherein the torque and drag analysis further uses at least one of mud weight, drillstring weight, downhole friction, weight on bit, thermal expansion, rig heave and drillpipe wear to produce a corrected time-depth file.

19. The non-transitory computer-readable medium of claim 15, wherein the program further comprising instructions for estimating uncertainty of depth correction due to mechanical stretch.

20. The non-transitory computer-readable medium of claim 19, wherein the estimating of the uncertainty is performed by analyzing a distribution of values of a parameter selected from the group consisting of mud weight, drillpipe wear, sliding friction factor, and a combination thereof, provided TIAH and TOMH are monotonous functions of the combination, wherein TIAH is trip-in actual hookload and TOMH is trip-out model hookload.

21. The non-transitory computer-readable medium of claim 20, wherein the parameter is the sliding friction factor.

22. The non-transitory computer-readable medium of claim 15, wherein the program further comprises instructions for estimating an uncertainty of a mechanical stretch due to sliding friction, the instructions for estimating the uncertainty comprising:

determining a distribution profile of parameter values for (TIMH-TIAH)/(TIMH) and (TOAH-TOMH)/TOMH; and calculating a spread and a mean of the parameter values.

23. The non-transitory computer-readable medium of claim 15, wherein the instructions for calibrating the effective block weight to match in-slip actual hookload (ISAH) comprise instructions for:

collecting ISAH data;

determining a median of the ISAH data collected; and setting the effective block weight to the median of the ISAH data collected.

* * * * *